US010259643B2

(12) United States Patent
Christianson

(10) Patent No.: US 10,259,643 B2
(45) Date of Patent: Apr. 16, 2019

(54) DISPENSING SYSTEM

(75) Inventor: Jeffrey J. Christianson, Oak Creek, WI (US)

(73) Assignee: S. C. JOHNSON & SON, INC., Racine, WI (US)

( * ) Notice: Subject to any disclaimer, the term of this patent is extended or adjusted under 35 U.S.C. 154(b) by 2374 days.

(21) Appl. No.: 12/317,459

(22) Filed: Dec. 22, 2008

(65) Prior Publication Data

US 2010/0155432 A1 Jun. 24, 2010

(51) Int. Cl.
*B65D 83/24* (2006.01)
*B05B 1/34* (2006.01)
*B65D 83/26* (2006.01)

(52) U.S. Cl.
CPC ..... *B65D 83/24* (2013.01); *B05B 1/3436* (2013.01); *B05B 1/3478* (2013.01); *B65D 83/262* (2013.01)

(58) Field of Classification Search
CPC ..... B05B 1/3436; B05B 1/3478; B65D 83/24; B65D 83/262
USPC ..... 239/337–339, 468, 471, 473, 491–492, 239/518, 583, 585.1, 585.4, 585.5; 251/129.15, 129.21
See application file for complete search history.

(56) References Cited

U.S. PATENT DOCUMENTS

| | | | | |
|---|---|---|---|---|
| 3,187,949 | A | 6/1965 | Mangel | |
| 3,271,001 | A * | 9/1966 | Per Gloersen et al. | 251/129.21 |
| 3,351,240 | A | 11/1967 | Gray | |
| 3,361,161 | A * | 1/1968 | Schwartz | 261/53 |
| 3,666,144 | A | 5/1972 | Winder | |
| 3,785,571 | A * | 1/1974 | Hoening | 239/492 |
| 4,074,861 | A | 2/1978 | Magers | |
| 4,721,250 | A * | 1/1988 | Kennedy et al. | 239/383 |
| 7,938,340 | B2 * | 5/2011 | Anderson et al. | 239/337 |
| 2007/0199952 | A1 | 8/2007 | Carpenter et al. | |
| 2008/0315016 | A1 | 12/2008 | Octeau et al. | |
| 2009/0078785 | A1 | 3/2009 | Herminghaus | |

FOREIGN PATENT DOCUMENTS

| | | | |
|---|---|---|---|
| EP | 1610045 | A1 | 12/2005 |
| GB | 2248888 | A | 4/1992 |
| WO | 02/40376 | A1 | 5/2002 |
| WO | 2006/087516 | A1 | 8/2006 |
| WO | WO 2006/087516 | | 8/2006 |
| WO | WO2007/045827 | * | 4/2007 |
| WO | WO 2008/115391 | | 9/2008 |

OTHER PUBLICATIONS

International Search Report in PCT/US2008/009664 dated Dec. 4, 2008.
International Search Report and Written Opinion dated Apr. 8, 2010 Appl. No. PCT/US2009/006673.

* cited by examiner

*Primary Examiner* — Christopher Kim
(74) *Attorney, Agent, or Firm* — Quarles & Brady LLP

(57) ABSTRACT

A dispensing system comprises a solenoid valve that includes an inlet end adapted to be attached to a container such that a valve stem thereof is held in an open state. A flow adapter includes a cylindrical wall and a post mounted within the cylindrical wall to define an annular passage therebetween. An inlet end of the flow adapter is sealingly attached to an outlet end of the solenoid valve, and the flow adapter is adapted to receive a spray insert within the annular passage.

20 Claims, 11 Drawing Sheets

DISPENSING SYSTEM

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present disclosure relates generally to a dispensing system for the release of a volatile material from a container, and more particularly, to a standardized solenoid activated valve system that includes a variable geometry flow adapter adapted to receive a variable geometry spray insert therein for the release of a volatile material from an aerosol container.

2. Description of the Background of the Invention

Aerosol containers are commonly used to store and dispense a variety of possible volatile materials such as air fresheners, deodorants, insecticides, germicides, decongestants, perfumes, and the like. The volatile material is stored under compression and a release valve on the aerosol container controls release of the volatile material. The release valve is activated by actuation of a valve stem through which the volatile material flows. Activation of the release valve may be accomplished by an automated system, for example, by a solenoid attached to a control circuit and a source of power.

Numerous volatile materials exist, which may have different fluid properties, for example, the volatility, the viscosity, the surface tension, or any other property of a fluidic volatile material may be different. Therefore, each of the possible volatile materials may benefit from a different dispensing system geometry for optimal dispensing. However, a dispensing system comprising a customized solenoid activated valve for optimal dispensing of each type of volatile material may become cost prohibitive. A solution is presently provided, which includes a standardized solenoid activated valve that includes one or more economically producible variable geometry adapters that are adapted to be replaceable and to receive any of a variety of economically producible variable geometry spray inserts.

SUMMARY OF THE INVENTION

According to one aspect of the invention, a dispensing system comprises a solenoid valve that includes an inlet end adapted to be attached to a container such that a valve stem thereof is held in an open state. A flow adapter includes a cylindrical wall and a post mounted within the cylindrical wall to define an annular passage therebetween. An inlet end of the flow adapter is sealingly attached to an outlet end of the solenoid valve, and the flow adapter is adapted to receive a spray insert within the annular passage.

According to another aspect of the invention, a dispensing system comprises a solenoid valve that includes an inlet end adapted to be attached to a container such that a valve stem thereof is held in an open state. A flow adapter includes a cylindrical wall and a post mounted within the cylindrical wall to define an annular passage therebetween. A spray insert includes an end wall and a cylindrical skirt extending therefrom, wherein an aperture is disposed through the end wall. An inlet end of the flow adapter is removably and sealingly attached to an outlet end of the solenoid valve, and the flow adapter receives the cylindrical skirt of the spray insert for attachment within the annular passage.

According to yet another aspect of the invention, a dispensing system comprises a solenoid valve that includes an inlet end adapted to be attached to a container such that a valve stem thereof is held in an open state. A flow adapter includes a cylindrical wall and a post mounted within the cylindrical wall to define an annular passage therebetween. A spray insert includes an end wall and a cylindrical skirt extending therefrom, wherein the end wall includes an aperture disposed therethrough and a groove disposed in an interior surface thereof. An inlet end of the flow adapter is sealingly attached to an outlet end of the solenoid valve, and the flow adapter receives the cylindrical skirt of the spray insert for attachment within the annular passage. The groove provides fluid communication between the annular passage and the aperture when the spray insert is attached to the flow adapter.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

Figure 1:
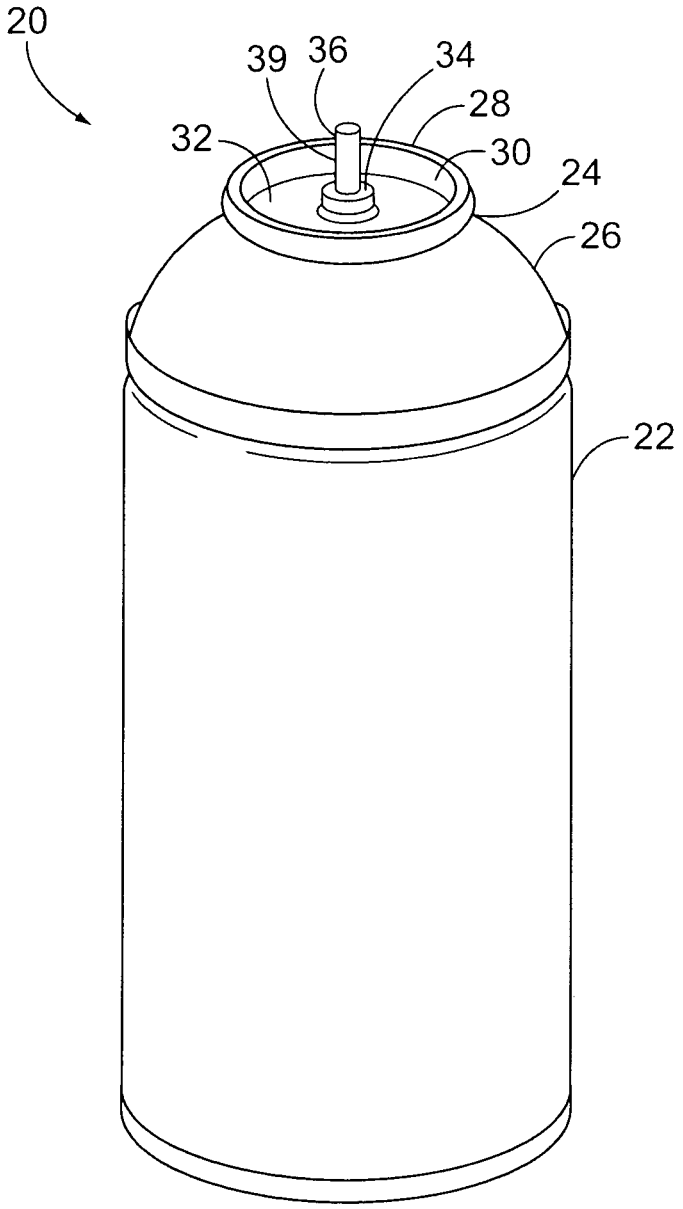
FIG. 1 is an isometric view of one type of aerosol container.
Figure 2:
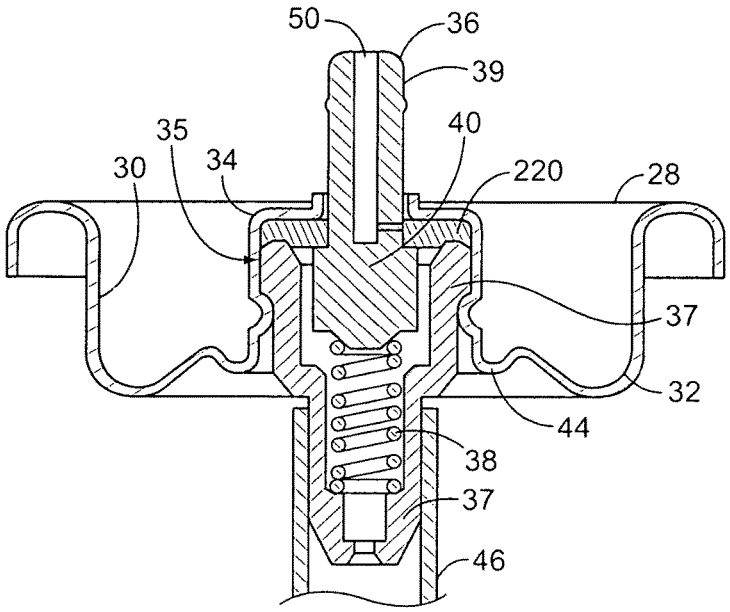
FIG. 2 is a cross-sectional view of one type of aerosol valve of the aerosol container of FIG. 1.

FIGS. 1 and 2 depict one type of aerosol container 20 well known to those skilled in the art. The aerosol container 20 comprises a body 22 with an opening 24 at a top end 26 thereof. A mounting cup 28 is crimped to the opening 24 of the container 20 to seal the top end 26 of the body 22. The mounting cup 28 is generally circular in geometry and may include an outer wall 30 that extends upwardly from a base 32 of the mounting cup 28 adjacent the area of crimping. A pedestal 34 also extends upwardly from a central portion of the base 32. A valve assembly 35 includes a valve stem 36, a valve body 37, and a valve spring 38. The valve stem 36 extends through the pedestal 34, wherein a distal end 39 extends upwardly away from the pedestal 34 and a proximal end 40 is disposed within the valve body 37. The valve body 37 is secured within an inner side 44 of the mounting cup 28. A dip tube 46 may be attached to the valve body 37. The dip tube 46 extends downwardly into an interior of the body 22 of the container 20. A button or other actuator (not shown) may be assembled onto the distal end 39 of the valve stem 36. A user depresses the button or other actuator to open the valve assembly 35. When the valve assembly 35 is opened, a pressure differential between the container interior and the atmosphere forces the contents of the container 20 out through an orifice 50 of the valve stem 36 and an exit orifice (not shown) of the button or other actuator. While the present disclosure describes the applicants' invention with respect to an aerosol container that is similar to the aerosol container 20, the present invention may be practiced with any type of aerosol container known to those skilled in the art.

Figure 3:
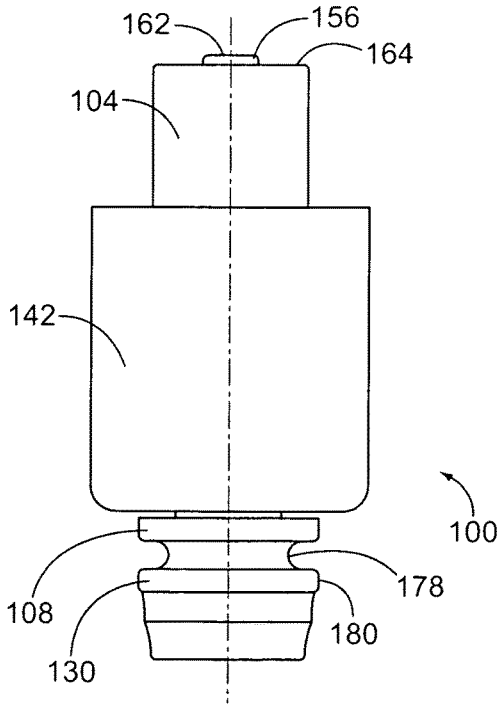
FIG. 3 is a side elevational view of one embodiment of a dispensing system.
Figure 4:
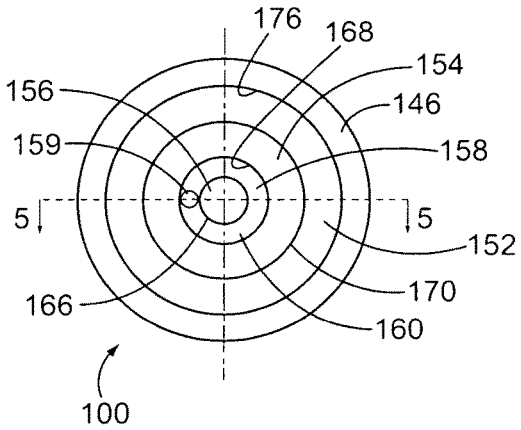
FIG. 4 is a top plan view of the dispensing system of FIG. 3.
Figure 5:
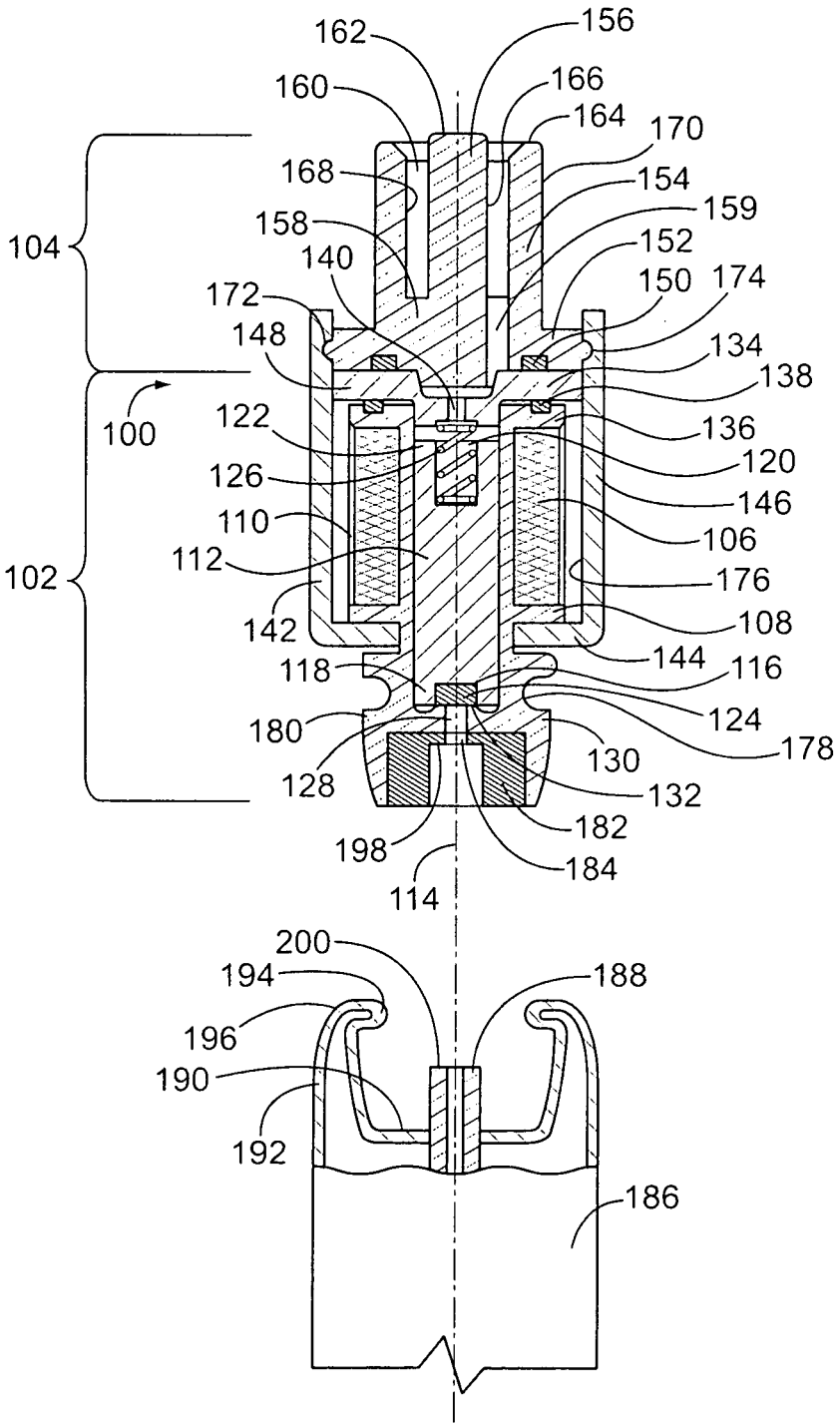
FIG. 5 is a cross-sectional view of the dispensing system of FIG. 3, taken generally along the line 5-5 of FIG. 4, in combination with a top end of an aerosol container in an inactive state.

FIGS. 3-5 depict one embodiment of a dispensing system 100 that comprises a solenoid valve 102 and a flow adapter 104. The solenoid valve 102 includes a solenoid coil 106, which is wrapped around a bobbin 108. The solenoid coil 106 is preferably made of wire, which could be a copper wire or any other wire known to one of skill in the art. The bobbin 108 is preferably made of a non-magnetic thermoplastic, e.g., polypropylene, nylon, or any other thermoplastic. Insulative tape 110, which may comprise any sort of non-conducting electrical tape, is provided around the solenoid coil 106.

A metal armature 112 fits within the bobbin 108 and is free to move along a longitudinal axis 114 of the bobbin 108. The metal armature 112 is made of a metal, e.g., SUS416 stainless steel, or any other metal known to those of skill in the art for utilization as a solenoid armature. The metal armature 112 includes an inlet recess 116 in an inlet end 118 thereof and an outlet recess 120 in an outlet end 122 thereof. A gap or space (not shown) between the metal armature 112 and the bobbin 108 allows fluid to flow around the armature 112 from the inlet end 118 thereof to the outlet end 122 thereof. A sealing valve seat 124 is mounted in the inlet recess 116 and a spring 126 is mounted in the outlet recess 120. The spring 126 is made of metal, for example, spring steel such as SUS304 stainless steel.

An inlet port 128 is provided within an inlet end 130 of the bobbin 108 and is surrounded by a raised annular surface 132. A face plate 134 is attached to an outlet end 136 of the bobbin 108. An o-ring 138 is positioned between the face plate 134 and the outlet end 136 of the bobbin 108 to provide a fluid seal therebetween. The o-ring 138 (and the sealing seat 124) preferably comprises a sealing material known to one of skill in the art, e.g., nitrile rubber. An outlet port 140 is provided within the face plate 134 opposite the outlet recess 120.

With reference to FIG. 5, the dispensing system 100 is shown in an inactive state. When the solenoid coil 106 is not energized, the spring 126 forces the sealing valve seat 124 against the raised annular surface 132 to form a seal therebetween. When the solenoid coil 106 is energized (see FIG. 6), the armature 112 is magnetically forced toward the outlet port 140, compressing the spring 126 and opening the seal at the inlet port 128 between the sealing valve seat 124 and the raised annular surface 132. A frame 142 includes an inwardly extending annular end wall 144 and a generally cylindrical skirt 146. The frame 142 attaches over the bobbin 108 and provides structural strength to hold the face plate 134 sealingly against the outlet end 136 of the bobbin 108. The frame 142 and the face plate 134 are preferably made of metal that can concentrate magnetic flux generated by the solenoid coil 106 within the frame, for example, SPCC cold-reduced carbon steel sheet could be utilized. The flow adapter 104 is removably attached to an outlet end 148 of the solenoid valve 102. An o-ring 150 is positioned between the flow adapter 104 and the outlet end 148 of the solenoid valve 102 to provide a fluid seal therebetween.

The flow adapter 104 includes an end wall 152 from which depends a cylindrical wall 154. A post 156 is mounted within the cylindrical wall 154, for example, via an intermediate wall 158. An annular passage 160 is defined between the post 156 and the cylindrical wall 154. A supply orifice 159 provides fluid communication between an inlet side of the intermediate wall 158 and the annular passage 160. An outlet end 162 of the post 156 extends beyond an outlet end 164 of the cylindrical wall 154. The annular passage 160 includes an inner surface 166 and an outer surface 168 and the cylindrical wall 154 includes an outer surface 170. The flow adapter 104 is removably attached to the solenoid valve 102 by a method of attachment as known to one having skill in the art. In the present embodiment, the flow adapter is snap-fit into the frame 142. Specifically, a rib 172 circumscribes a perimeter of the end wall 152 and a groove 174 circumscribes an interior surface 176 of the frame 142. When the flow adapter 104 is pressed axially downward toward the frame 142, the rib 172 locks into the groove 174 and causes the compression of the o-ring 150 to provide a seal between the flow adapter 104 and the outlet end 148 of the solenoid valve 102.

The solenoid valve 104 further includes a circumferential groove 178 disposed around an outer surface 180 of the bobbin 108 proximate to the inlet end 130 thereof. A sealing washer 182 is press fit into the inlet end 130 of the bobbin. The sealing washer 182 is made of a sealing material, e.g., nitrile rubber, and includes an aperture 184 that is aligned with the inlet port 128.

It is contemplated that the use of a flow adapter 104, such as described herein, promotes the use of a standardized solenoid valve 102 with any number of different fluids. The dispensing system 100 may be customized for a particular fluid or a particular application by attachment of a particular type of flow adapter 104 chosen from a variety of flow adapters. For example, the size of the annular passage 160 may be enlarged or made smaller for use with a particular application. The flow adapter 104 is relatively inexpensive to design and produce compared to the solenoid valve 102, and may, for example, be mass produced by injection molding of thermoplastic material. An economically produced yet customizable flow adapter when used in conjunction with a specialized spray insert and a standardized solenoid valve allows flexibility for effectively dispensing a variety of products with a low cost of production.

Figure 6:
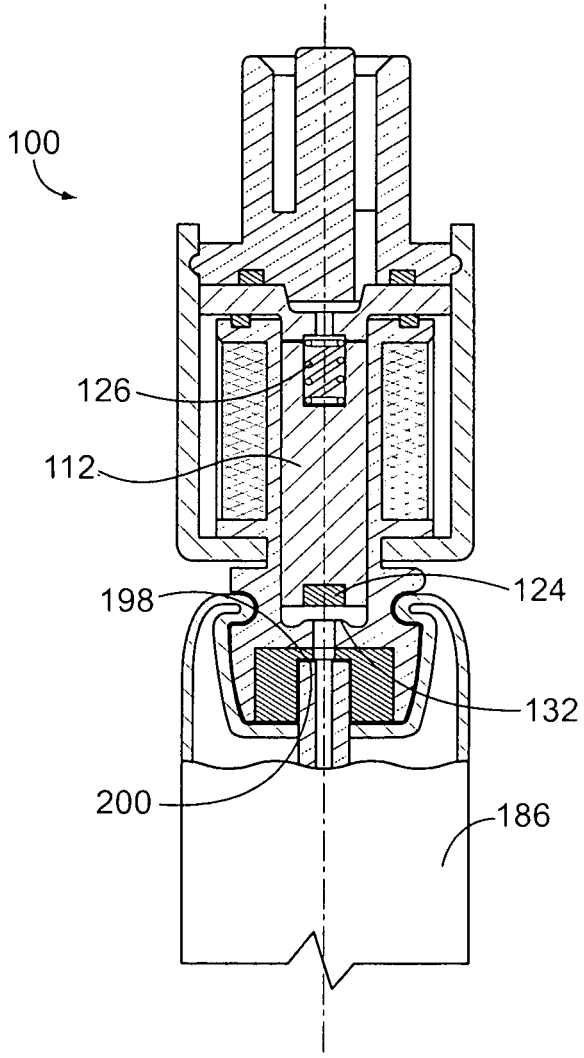
FIG. 6 is a cross-sectional view of the dispensing system of FIG. 5 shown in an active state.

The inlet end 130 of the bobbin 108 is adapted to be attached to a container that is similar to the container 20 (see FIGS. 1 and 2), such that a valve stem thereof is held in an open state (see FIG. 6). Illustratively referring to FIGS. 5 and 6, an embodiment of a container 186 includes a valve stem 188 protruding from an end 190 of the container 186.

A skirt 192 projects away from the end 190 and surrounds the valve stem 188. An inwardly projecting lip 194 on a distal end 196 of the skirt 192 may be sized and positioned to snap into the groove 178 when the sealing washer 182 is sealingly attached over the valve stem 188. Such an attachment also forces a surface 198 of the sealing washer 182 against a distal end 200 of the valve stem 188, forcing the valve stem 188 toward the container 186 and into an open state. Thus, the lip 194 snaps into the groove 178 to attach the dispensing system 100 to the container 186 and holds the valve stem 188 in an open state.

Figure 7:
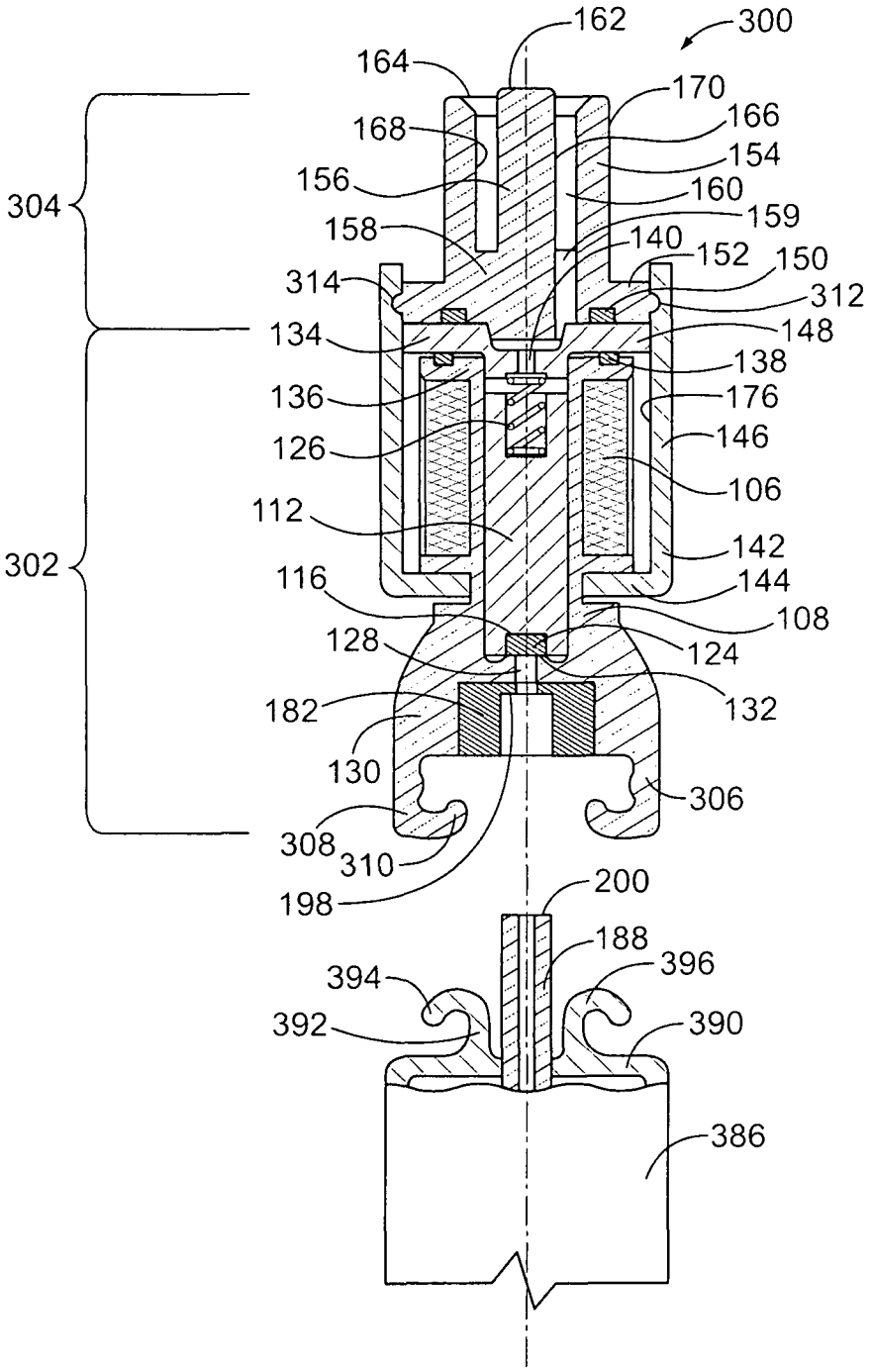
FIG. 7 is a cross-sectional view of another embodiment of a dispensing system similar to the one shown in FIG. 5, taken generally along the line 5-5 of FIG. 4, in combination with a different top end of an aerosol container.

Another embodiment of a dispensing system 300 shown in FIG. 7 is substantially similar to the dispensing system 100 described hereinabove with regard to FIGS. 3-6, except for the following differences. Referring to FIG. 7, the dispensing system 300 includes a solenoid activated valve 302 and a removably attachable flow adapter 304. The solenoid activated valve 302 includes a cylindrical skirt 306 that projects longitudinally beyond the sealing washer 182. A distal end 308 of the cylindrical skirt 306 includes an inwardly depending annular lip 310. An embodiment of a container 386 includes the valve stem 188 protruding from an end 390 thereof. A skirt 392 projects away from the end 390 and surrounds the valve stem 188. When the dispensing system 300 is forced against the container 386, an outwardly projecting annular lip 394 on a distal end 396 of the skirt 392 and the inwardly depending annular lip 310 are sized and positioned to snap past one another to attach the dispensing system 300 to the container 386. Such an attachment also forces the surface 198 of the sealing washer 182 against the distal end 200 of the valve stem 188, forcing the valve stem 188 toward the container 186 and into an open state. Thus, the outwardly projecting annular lip 394 and the inwardly depending annular lip 310 snap past one another to attach the dispensing system 300 to the container 386 and to hold the valve stem 188 in an open state.

Figure 8:
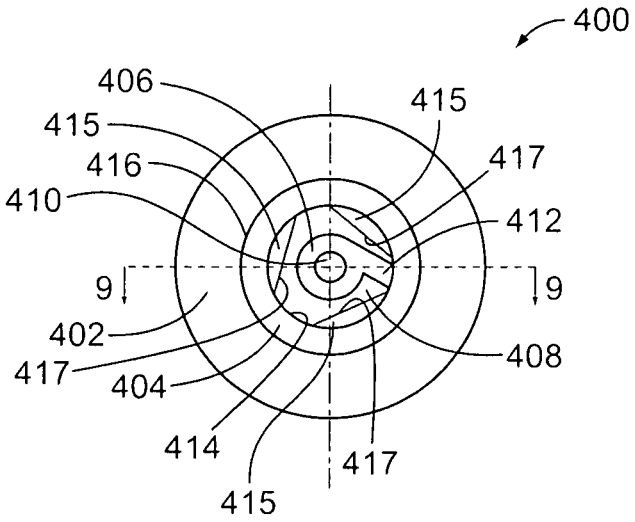
FIG. 8 is a bottom elevational view of one embodiment of a spray insert.
Figure 9:
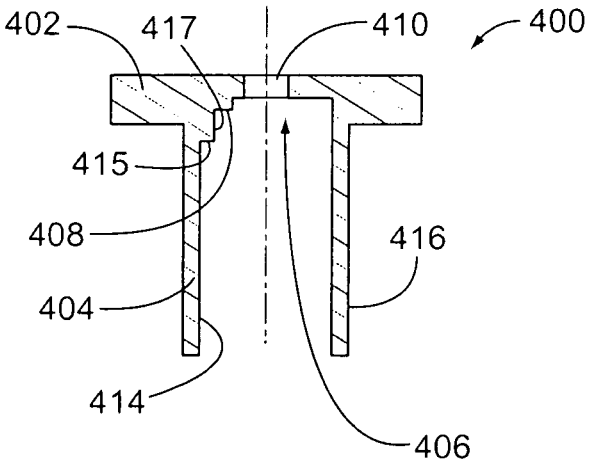
FIG. 9 is a cross-sectional view of the spray insert of FIG. 8, taken generally along the line 9-9 of FIG. 8.

Referring to FIGS. 8 and 9, one embodiment of a spray insert 400 is shown, which includes an end wall 402 and a cylindrical skirt 404 extending therefrom. A recess 406 is provided within an interior surface 408 of the end wall 402. An aperture 410 extends through the end wall 402. The interior surface 408 of the end wall 402 further includes a groove 412 that runs from the recess 406 to an inner surface 414 of the cylindrical skirt 404.

Figure 10:
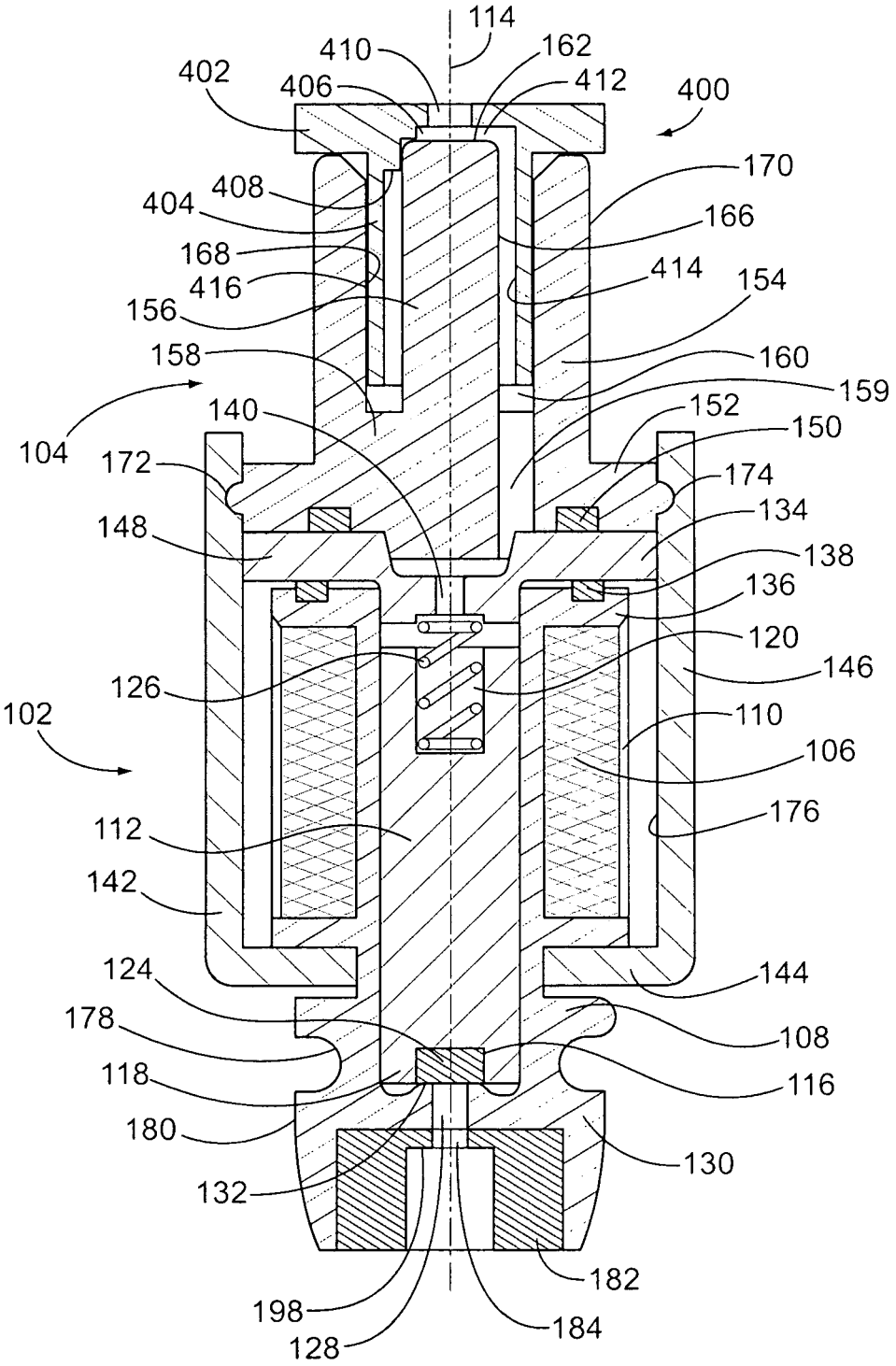
FIG. 10 is an enlarged cross-sectional view of the dispensing system shown in FIG. 5 with the spray insert of FIG. 8 attached thereto, taken generally along the line 5-5 of FIG. 4, with portions behind the plane of section removed for purposes of clarity.

Referring to FIG. 10, the spray insert may be removably attached to a flow adapter, e.g., the flow adapter 104, by press fitting the cylindrical skirt 404 into the annular passage 160. An outer surface 416 of the cylindrical skirt 404 is held by frictional engagement against the outer surface 168 of the annular passage 160. In addition, the spray insert 400 may include one or more steps 415 that extend away from the inner surface 414. The steps 415 provide surfaces 417 that tangentially engage the post 156 at the surface 166 to assist in correctly seating and centering the spray insert 400 in the flow adapter 104. The surfaces 417 may be straight surfaces as illustrated in FIGS. 8, 11A, 11E, and 13A-13G, or may be curved surfaces as illustrated in FIGS. 11B-11D, 11F, and 12.

When the spray insert 400 is inserted into the flow adapter 104, contact between a central portion of the interior surface 408 that surrounds the recess 406 and the outlet end 162 of the post 156 closes off the central portion of the interior surface 408 and the recess 406 from fluid communication with the annular passage 160 except for the groove 412. Fluid passing through the solenoid valve 102 passes from the inlet port 128 to the outlet port 140 via a space between the armature 112 and a wall of the bobbin 108. The fluid exits the outlet port 140 and passes through the annular passage 160 to the groove 412. The fluid passes through the groove 412 and into the recess 406 before exiting the spray insert 400 through the aperture 410.

The spray insert 400 described hereinabove with regard to FIGS. 8 and 9 illustrates a recess 406 that is generally circular and a groove 412 that enters the recess 406 generally tangential to a perimeter of the recess 406. However, the spray insert 400 is but one illustration of a variety of possible geometries for the recess 406 and the groove 412. Other embodiments of a spray insert (for example, see FIG. 12) may not include a recess in addition to the groove (or grooves) 602-610 that feed the aperture 410. In addition, it is contemplated that one or more of the grooves 602-610 may include side walls that are not straight or parallel, providing the groove with a cross-sectional area that varies between inlet and outlet ends thereof or a protrusion that extends from a first side wall into the groove around which flow may separate to induce turbulence therein.

Figure 11A:
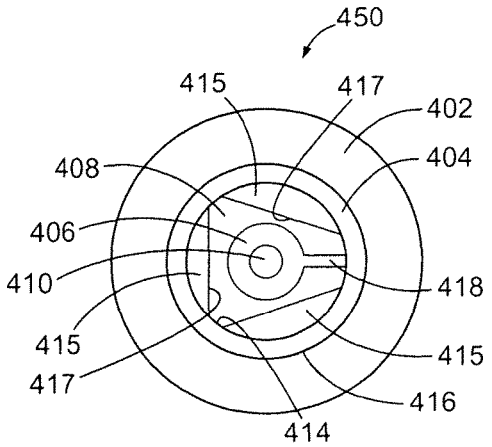
FIGS. 11A-11F are bottom elevational views of different embodiments of spray inserts.
Figure 11B:
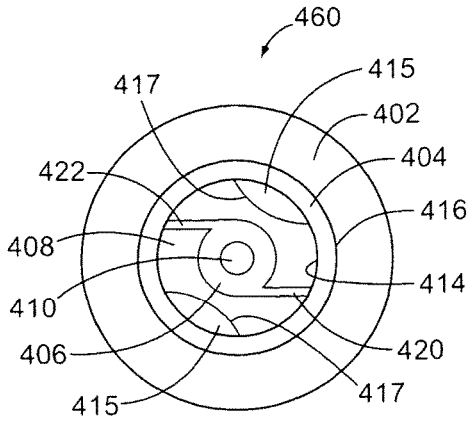
Figure 11C:
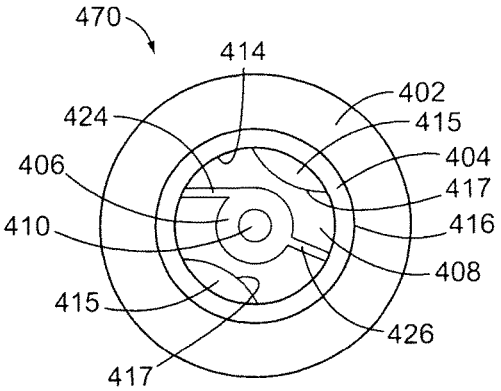

Referring to FIGS. 11A-11F, a number of spray inserts are illustrated each having a central recess. A groove may enter the generally circular recess 406 at any angle relative to the perimeter of the recess 406 between and including generally tangential to and generally normal to the perimeter of the recess 406. For example, a groove 418 enters the recess 406 generally normal to the perimeter thereof, as illustrated for the spray insert 450 in FIG. 11A. In other embodiments of a spray insert there may be two or more grooves that run from the inner surface 414 of the cylindrical skirt 404 to the recess 406. For example, in the embodiment of a spray insert 460, two grooves 420, 422 each enter the recess 406 generally tangential to the perimeter thereof, as shown in FIG. 11B. As shown in another example in FIG. 11C, an embodiment of a spray insert 470 includes a first groove 424 that enters the recess 406 generally tangential to the perimeter thereof and a second groove 426 that enters the recess 406 generally normal to the perimeter thereof.

Figure 11D:
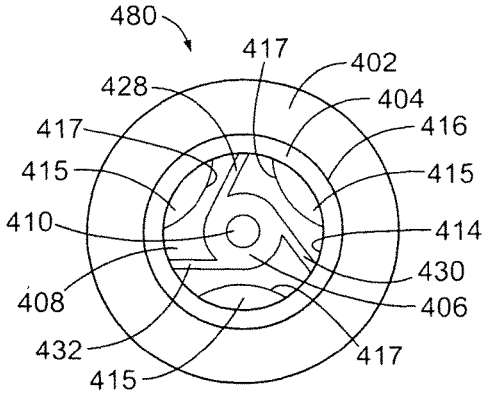

Tailoring the geometry of the recess 406 as well as the angle of entry and the number of grooves that enter the recess 406 allows selection of swirl and/or mixing patterns that may be desirable for a particular fluid or spray application. FIG. 11D illustrates another embodiment of a spray insert 480 that includes three grooves 428, 430, and 432, each groove entering the generally circular recess 406 tangential to a perimeter thereof. The grooves 428, 430, and 432 are illustrated as each entering the recess 406 in a counterclockwise direction; however, one or more of the grooves 428, 430, and 432 may enter the recess 406 in a clockwise direction (not shown) to oppose one or more of the remaining grooves and possibly promote mixing within the recess 406.

Figure 11E:
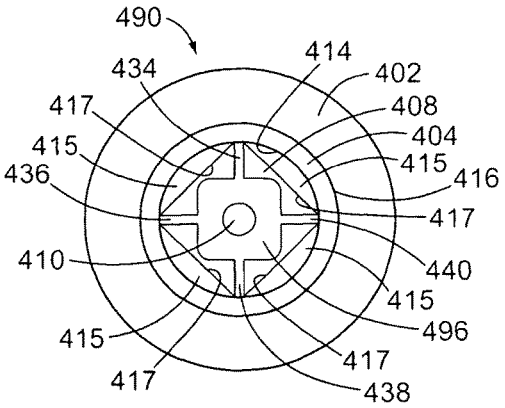
Figure 11F:
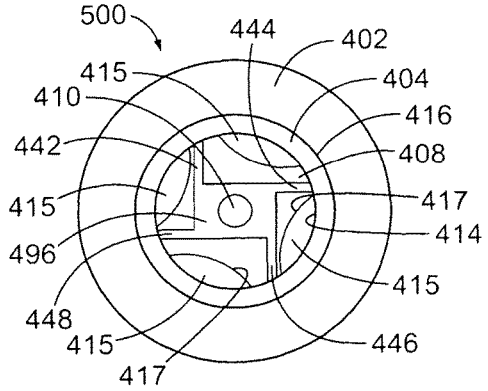

The recess 406 has been illustrated hereinabove as having a generally circular shape; however, any shape may be utilized as may be desirable to promote swirl, turbulence, mixing, or other effects in a spray of fluid exiting through the aperture 410. For example, the recess 406 may be a polygonal shape such as a triangle, rectangle, pentagon, hexagon, heptagon, octagon, etc., ultimately approaching a generally circular shape as the number of sides is increased further. FIG. 11E illustrates an embodiment of a spray insert 490 that includes a generally rectangular (it being understood that a square is a rectangle) recess 496. Four grooves 434, 436, 438, and 440 each enter the recess 496 normal to a perimeter thereof. In yet another embodiment of a spray insert 500, as illustrated in FIG. 11F, four grooves 442, 444, 446, and 448 each enter the generally rectangular recess 496 tangential to a perimeter thereof.

Figure 12:
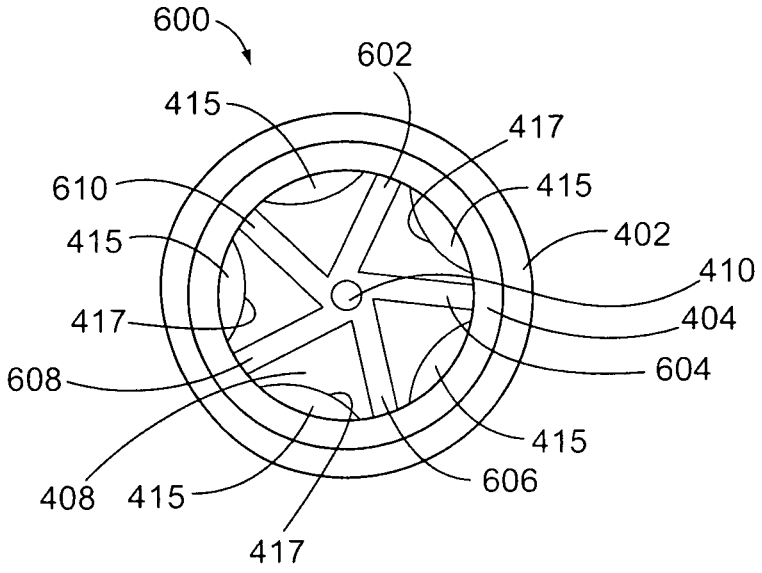
FIG. 12 is a bottom elevational view of another embodiment of a spray insert.

A further embodiment of a spray insert 600, illustrated in FIG. 12, includes five grooves 602, 604, 606, 608, and 610, which lack the central recess 406, 496. In this embodiment, exit ends of the grooves 602, 604, 606, 608, 610 feed the aperture 410 such that fluid exiting one of the grooves may directly interact with fluid exiting any of the other grooves before exiting through the aperture 410. A spray insert like the spray insert 600 could be produced with six or more grooves as desired or required by the particular application. In fact, the actual number of grooves that may be utilized in a spray insert is limited only by practical considerations of manufacture and size of the insert.

Figure 13A:
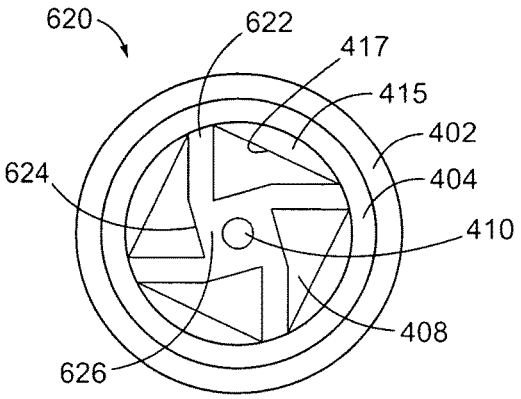
FIGS. 13A-13G are bottom elevational views of further embodiments of spray inserts.
Figure 13B:
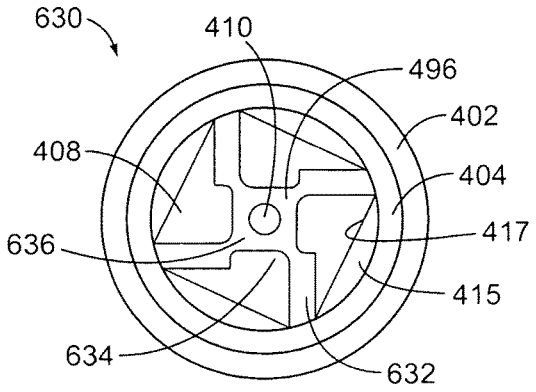
Figure 13C:
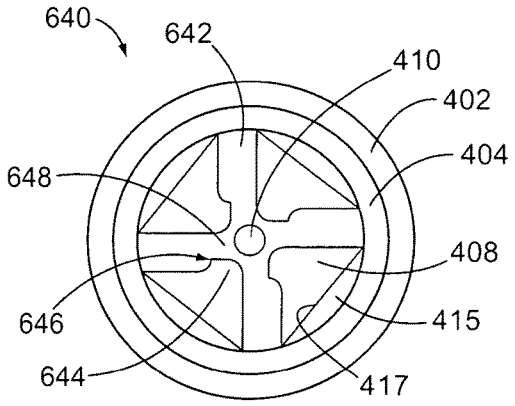
Figure 13D:
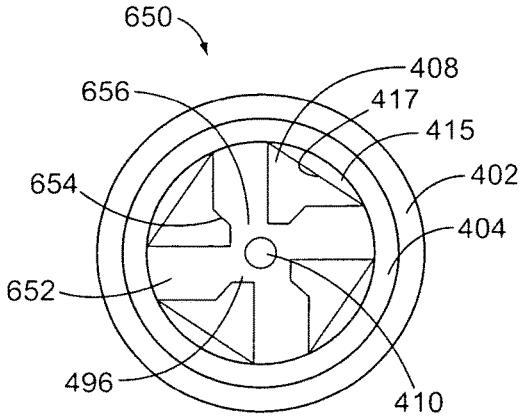

Referring now to FIGS. 13A-13G, a number of embodiments of spray inserts are illustrated each having one or more grooves defined by side walls that are not straight or parallel. For example, a spray insert 620 includes four grooves 622, each having a portion 624 of a side wall angled into the groove 622 proximate an exit end 626 thereof, as illustrated in FIG. 13A. The spray insert 620 lacks a recess 406, 496. Referring to FIG. 13B, another embodiment of a spray insert 630 is similar to the spray insert 620 described with regard to FIG. 13A, except that the spray insert 630 includes four grooves 632, each including a generally rectangular protrusion 634 extending thereinto proximate to an exit end 636 thereof. This embodiment has a generally rectangular recess 496. Referring to FIG. 13C, a further embodiment of a spray insert 640 is similar to the spray insert 630 described with regard to FIG. 13B, except that the spray insert 640 includes four grooves 642, each including a generally rectangular protrusion 644 having a sharp inner corner 646 and extending into the groove 642 proximate to an exit end 648 thereof. Yet a further embodiment of a spray insert 650 includes a recess 496 and four grooves 652 that each include a portion 654 of a side wall angled into the groove 652 proximate an exit end 656 thereof, as illustrated in FIG. 13D.

Figure 13E:
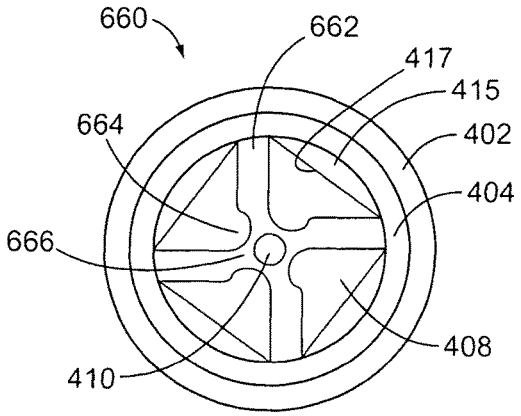
Figure 13F:
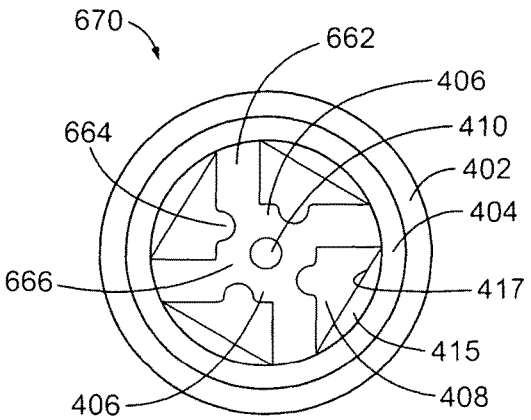
Figure 13G:
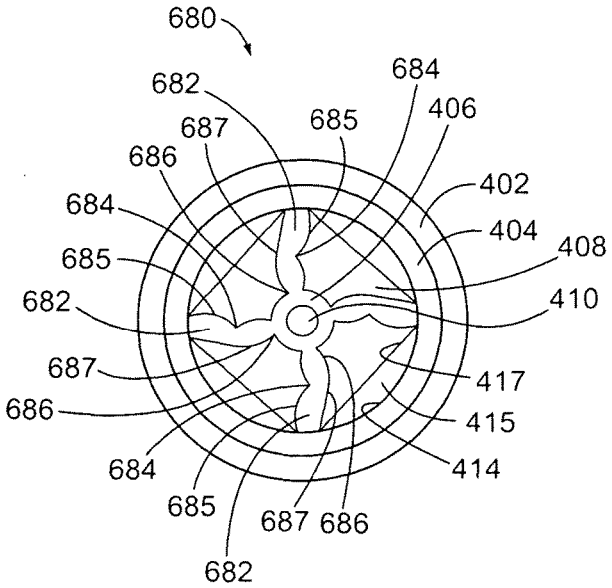

Referring to FIG. 13E, another embodiment of a spray insert 660 is similar to the spray insert 640 described with regard to FIG. 13C, except that the spray insert 660 includes four grooves 662, each including a generally semi-circular protrusion 664 extending thereinto proximate to an exit end 666 thereof. FIG. 13F illustrates a further embodiment of a spray insert 670 that is similar to the spray insert 660 described with regard to FIG. 13E, except that the spray insert 670 includes the generally circular recess 406. Another embodiment of a spray insert 680 includes four grooves 682, each including a protrusion 684 extending from a first side wall 685 into the groove 682, as illustrated in FIG. 13G. Each groove 682 further includes a portion 686 of a second opposite sidewall 687 that is disposed downstream from the protrusion 684 and that curves into the groove 682 to diminish the cross-sectional area thereof.

A spray insert as described hereinabove, for example, any of 400, 450, 460, 470, 480, 490, 500, 600, 620, 630, 640 650, 660, 670, and 680 may economically be made by injection molding of a thermoplastic material, for example, polypropylene, nylon, or other thermoplastic material as is known in the art. A dispensing system that includes a removably attachable spray insert along with a removably attachable flow adapter 104, 304 in conjunction with a standardized solenoid valve 102, 302 allows great flexibility for use of such a dispensing system with a variety of different fluids and spraying applications and will provide greater economic benefits with reduced production costs.

Any of the embodiments described herein may be modified to include any of the structures or methodologies disclosed in connection with different embodiments. Further, the present disclosure is not limited to containers of the type specifically shown or to methods of attachment of a container to a dispensing means, a flow adapter to a solenoid valve, or a spray insert to a flow adapter as specifically shown. Still further, the method of attachment to a container of any of the embodiments disclosed herein may be modified to work with any type of fluid container having a tilt-activated valve stem.

Industrial Applicability

Aerosol dispensers are commonly used to dispense a variety of volatile materials such as air fresheners, deodorants, insecticides, germicides, decongestants, perfumes, and the like, that are stored within aerosol containers. Automated valve activation systems for aerosol containers allow the contents thereof to be released without human interaction, for example, according to a predetermined time schedule. The variety of volatile materials may each optimally be dispensed with a particular valve geometry. A standardized solenoid activated valve is provided that includes one or more variable geometry flow adapters, each adapter adapted to be attached to an end of the standard solenoid valve. Each adapter includes a post and barrel structure defining an annular passage that is adapted to allow insertion of a variable geometry spray insert therein. Variable geometry spray inserts can be inexpensively produced for a variety of fluids and applications and can be used with the standardized solenoid valve and a variable geometry flow adapter to optimally dispense each of the variety of fluids.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

I claim:

1. A dispensing system, comprising:

a solenoid valve that includes an inlet end configured to couple to an aerosol container, including a valve stem, at a first location surrounding the valve stem and a second location disposed radially outward from the first location; and a flow adapter that includes a cylindrical wall and a post mounted within the cylindrical wall to define an annular passage therebetween, wherein an inlet end of the flow adapter is sealingly attached to an outlet end of the solenoid valve, and the flow adapter is adapted to receive a spray insert within the annular passage.

2. The dispensing system of claim 1, wherein the flow adapter is removably attached to the outlet end of the solenoid valve.

3. The dispensing system of claim 1, wherein an o-ring is disposed between the inlet end of the flow adapter and the outlet end of the solenoid valve.

4. The dispensing system of claim 3, wherein the outlet end of the solenoid valve includes an annular face plate attached to a bobbin of the solenoid valve and a second o-ring is disposed between the annular face plate and the bobbin.

5. The dispensing system of claim 1, wherein the solenoid valve is normally closed.

6. The dispensing system of claim 5, wherein the solenoid valve includes an armature that has an inlet recess and an outlet recess at inlet and outlet ends thereof, respectively, and wherein the outlet recess accommodates a spring and a valve seat is disposed in the inlet recess.

7. The dispensing system of claim 6, wherein an inlet port disposed through an inlet end of a bobbin of the solenoid valve provides fluid communication between a valve stem of a container and the valve seat, and the inlet port is surrounded by a raised annular surface against which the valve seat forms a seal when the solenoid valve is closed.

8. The dispensing system of claim 7, wherein when the solenoid valve is open, fluid communication is provided from the inlet port to an outlet port disposed through an outlet end of the solenoid valve via a space between the armature and a wall of the bobbin.

9. A dispensing system, comprising:

a solenoid valve that includes an inlet end adapted to be attached to an aerosol container including a valve stem and a crimped portion, the inlet end having an opening defined by a surface disposed therein, the surface configured to depress the valve stem such that the valve stem is held in an open state when the aerosol container is attached to the dispensing system;

a flow adapter that includes a cylindrical wall and a post mounted within the cylindrical wall to define an annular passage therebetween; and a spray insert that includes an end wall and a cylindrical skirt extending therefrom, wherein an aperture is disposed through the end wall, and wherein an outlet end of the solenoid valve includes an outlet port and a sidewall spaced from the outlet port, the sidewall forming a recess to receive an inlet end of the flow adapter, such that the inlet end of the flow adapter is removably and sealingly attached to the outlet end of the solenoid valve, and the flow adapter receives the cylindrical skirt of the spray insert for attachment within the annular passage.

10. The dispensing system of claim 9, wherein an outer surface of the skirt of the spray insert is removably attached to an outer surface of the annular passage.

11. The dispensing system of claim 10, wherein the aperture disposed through the end wall is disposed within a recess in an interior surface of the end wall and a groove is further disposed in the interior surface of the end wall, wherein the groove provides fluid communication between the annular passage and the recess when the spray insert is attached to the flow adapter.

12. The dispensing system of claim 11, wherein the groove enters the recess generally tangential to a perimeter of the recess.

13. A dispensing system, comprising:

a container including a valve stem and a crimped portion;

a solenoid valve that includes an inlet end adapted to be attached to the container such that the valve stem is held in an open state;

a flow adapter that includes a cylindrical wall and a post mounted within the cylindrical wall to define an annular passage therebetween;

a spray insert that includes an end wall and a cylindrical skirt extending therefrom, wherein the end wall includes an aperture disposed therethrough, and wherein an outlet end of the solenoid valve includes an outlet port and a sidewall spaced from the outlet port, the sidewall forming a recess to receive an inlet end of the flow adapter, such that the inlet end of the flow adapter is sealingly attached to the outlet end of the solenoid valve, and the flow adapter receives the cylindrical skirt of the spray insert for attachment within the annular passage.

14. The dispensing system of claim 13, wherein the flow adapter is removably attached to the outlet end of the solenoid valve.

15. The dispensing system of claim 13, wherein an outer surface of the skirt of the spray insert is removably attached to an outer surface of the annular passage.

16. The dispensing system of claim 13, wherein the end wall includes two or more grooves disposed in the interior surface thereof in fluid communication with the aperture.

17. The dispensing system of claim 16, wherein at least one of the two or more grooves includes a cross-sectional area that varies between inlet and outlet ends thereof.

18. The dispensing system of claim 17, wherein the at least one of the two or more grooves includes a protrusion that extends from a first side wall into said at least one of the two or more grooves.

19. The dispensing system of claim 18, wherein the at least one groove further includes a portion of a second sidewall that is disposed downstream from the protrusion and that curves into the groove to diminish the cross-sectional area thereof.

20. The dispensing system of claim 16, wherein a recess is disposed in the interior surface of the end wall, wherein the recess surrounds the aperture and is in fluid communication with outlet ends of the two or more grooves.

* * * * *